United States Patent [19]

Graf

[11] Patent Number: 4,838,007

[45] Date of Patent: Jun. 13, 1989

[54] HAND DEVICE FOR VARYING THE PRESSURE OF VALVE-LESS BALLS

[76] Inventor: Bernhard Graf, Pfaffstr. 14, 7500, Karlsruhe 41, Fed. Rep. of Germany

[21] Appl. No.: 168,774

[22] Filed: Mar. 16, 1988

[30] Foreign Application Priority Data

Mar. 18, 1987 [DE] Fed. Rep. of Germany ..... 3708842

[51] Int. Cl.[4] ..... B65B 31/00

[52] U.S. Cl. ..... 53/84; 53/88

[58] Field of Search ..... 53/79, 84, 88, 403; 156/94, 146, 147; 273/61 D

[56] References Cited

U.S. PATENT DOCUMENTS

| | | | |
|---|---|---|---|
| 3,921,977 | 11/1975 | Brink | 53/403 X |
| 3,974,622 | 8/1976 | Stubblefield, Jr. | 53/403 |
| 4,098,048 | 7/1978 | Sawa | 53/403 |
| 4,114,350 | 9/1978 | Snyder | 53/79 |
| 4,251,073 | 2/1981 | Birdsong, Jr. | 53/403 X |

FOREIGN PATENT DOCUMENTS

| | | | |
|---|---|---|---|
| 3228761 | 3/1984 | Fed. Rep. of Germany | 273/61 D |

*Primary Examiner*—John Sipos

*Attorney, Agent, or Firm*—Sughrue, Mion, Zinn, Macpeak & Seas

[57] ABSTRACT

A hand device for varying the gas pressure in a valve-less ball comprises a holding structure in which the ball is held non-rotatably and an injection syringe which is introduced into a longitudinal bore in a handle of the holding structure. During the introduction movement the hollow needle of the syringe perforates the wall of the ball and finally projects by a portion thereof into the interior of the ball. The syringe can be operated to inject into the ball a sealing agent which has been previously drawn into the injection syringe and then, after the piston has been removed from the syringe, the connecting portion of an air pump may be introduced into the open end of the syringe cylinder to pump the ball up to the desired pressure which is indicated by a pressure measuring arrangement, the injected sealing agent closing off the perforation formed by the needle when the syringe and the air pump are withdrawn from the holding structure.

18 Claims, 3 Drawing Sheets

Fig. 2
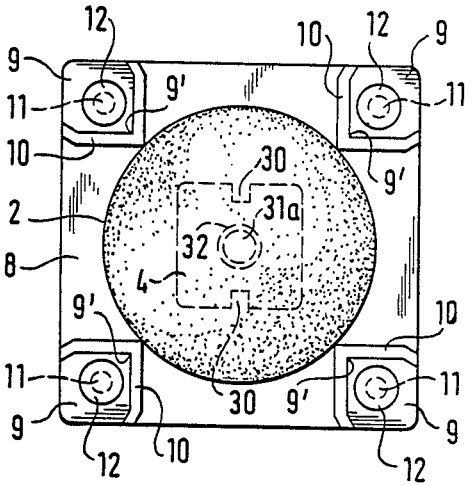
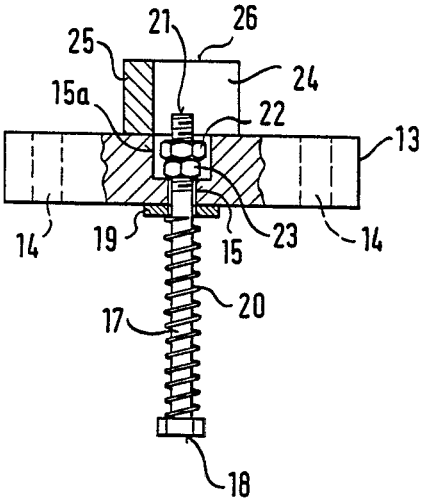
Fig. 3
Fig. 4
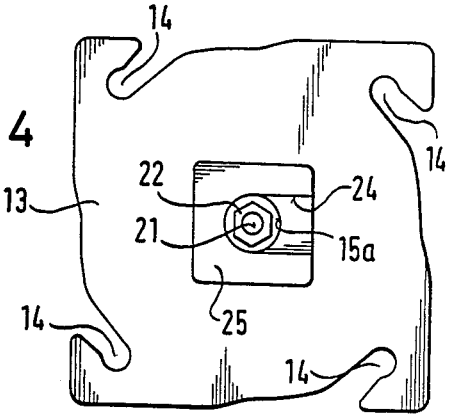

HAND DEVICE FOR VARYING THE PRESSURE OF VALVE-LESS BALLS

BACKGROUND OF THE INVENTION

The invention relates to a hand device for varying the gas pressure in valve-less balls such as more particularly but not exclusively tennis balls.

A hand device for that purpose, as is to be found for example in U.S. Pat. No. 4,114,350, comprises a hollow needle which is designed to penetrate the wall of a ball whose pressure is to be varied, so as to extend into the interior thereof, the hollow needle being in the form of a substantial tubular member which is screwed by means of its base portion into a transverse wall of a substantially cylindrical outside housing. A further cylindrical housing can be introduced into the outside housing, from above, slidably axially relative to the hollow needle, with the bottom of the further cylindrical housing being formed by a base plate which is designed to support the ball when it is introduced laterally into the further housing. Disposed above the ball in the further cylindrical housing is an axially displaceable plate-shaped measuring member which is urged towards the ball by means of a compression spring supported against an upper cover portion of the further housing, in such a way that from the beginning of the operation of varying the pressure of the ball, the ball is in a position of being clearly compressed from above and from below. Below the transverse wall of the substantially cylindrical outside housing, in the handle portion of the device, the outside housing forms a chamber for an aerosol can which is connected to the hollow needle by way of a valve and a supply conduit, through the transverse wall of the housing. When the further housing which accommodates the ball is introduced into the outside housing from above, the hollow needle passes through an axial bore in the above-mentioned base plate and penetrates the wall of the ball which bears against the base plate, to extend into the interior thereof. When thereupon the valve of the aerosol can is operated, a mixture of compressed air and sealing agent which is contained in the aerosol can then flows under pressure through the supply conduit and the hollow needle into the interior of the ball.

Now, while the above-discussed device, when used in relation to tennis balls or balls of a similar size thereto, can still be referred to as a hand device, nonetheless, with its comparatively large outside housing which contains an aerosol can in the handle portion thereof and the further housing which serves to accommodate the ball, that device is very cumbersome to handle and is expensive to produce, by virtue of its complicated structure. The fact that an aerosol mix of air and sealing agent is introduced into the ball through the hollow needle means that a very large amount of sealing agent is required, in order to cover in the interior of the ball, around the hollow needle, the whole of the area of the ball which has been pressed into a flat condition, with a layer of sealing agent of adequate thickness to provide a satisfactory seal so that, when the hollow needle is withdrawn from the ball, a sufficient amount of sealing agent can flow into the comparatively large perforation formed in the ball by the needle, and thereby seal it off again. If the internal pressure of the ball is to be increased only slightly or even reduced, then, after the hollow needle has been pushed into the ball, the ball must first be reduced in pressure to such a degree that thereupon a suitably large amount of the mixture of compressed air and sealing agent can be introduced into the ball from the aerosol can. As the ball does not have any lateral guide in the further housing of the device and as the above-mentioned measuring member which is subjected to the force of a compression spring must remain movable, with a certain amount of lateral play, it is not out of the question that the ball may move away laterally as it is pumped up, so that transverse forces are applied to the hollow needle; such forces can only be carried by a hollow needle which is of suitable thickness. That results in a comparatively large perforation in the wall of the ball, and that means that there is only a low level of reliability in securely re-closing the perforation in the wall of the ball, in the long term, even when using large amounts of sealing agent. Moreover, the content of an aerosol can for use in the above-discussed hand device is only sufficient for a limited number of operations of increasing the pressure in the ball so that that device involves a considerable level of running costs, when it is used frequently. Finally, the propellent gas which is required for aerosol cans to operate generally has a disadvantageous effect in varying the playing properties of the balls when treated in the above-indicated manner, which is another factor that has a serious adverse effect on the utility of the above-described device, in particular for use in relation to tennis balls.

SUMMARY OF THE INVENTION

An object of the present invention is to provide a hand device for varying the gas pressure in valve-less balls, which is of a simple and inexpensive construction and which can be easily operated without a high level of operator skill.

Another object of the present invention is to provide a hand device for varying the gas pressure in valve-less balls, which makes it possible to use a hollow needle of very fine nature for introducing compressed gas such as air into the ball to increase the pressure thereof, without leaving a substantial perforation in the wall of the ball.

Still another object of the present invention is to provide a hand device for varying the gas pressure in valve-less balls, which is foolproof in operation and which requires the use of a small amount of sealing agent for sealing off the perforation produced in the wall of the ball for inflation thereof.

A further object of the present invention is to provide a hand device for varying the gas pressure in valve-less balls, which provides for satisfactorily holding the ball in position during the operation of varying the gas pressure therein, without requiring careful alignment steps as between parts of the apparatus and/or the ball.

In accordance with the present invention, those and other objects are achieved by a hand device for varying the gas pressure in valve-less balls, comprising a holding means for non-rotatably accommodating the ball and comprising a base plate extending transversely with respect to the longitudinal direction of the holding means, for supporting the ball whose gas pressure is to be varied. A hollow needle projects in the operative position through a central opening in the base plate, beyond the surface thereof towards the ball and extends into the interior of the ball through a perforation pierced by the needle. A handle or gripping portion is disposed on the side of the base plate opposite to the ball and includes a conduit for introducing or releasing compressed gas into or from the ball through the hollow needle. A pressure measuring means includes a measuring member which is movable in the axial direction and which in the operative position bears against the ball on the side thereof opposite to the base plate and thus to the hollow needle while being pressed towards the ball by a compression spring which is supported against a cover means of the holding means. The pressure measuring device includes a movable measuring mark connected to the movable measuring body and which, when the ball is at the desired internal pressure, comes into alignment with a fixed measuring mark on the body of the holding means. The hollow needle is formed by the injection needle of aninjection syringe or plunger unit which with its cylinder portion forms the conduit for introducing compressed gas into the ball. Extending through the handle portion which is connected to the base plate is a longitudinal bore into which the injection syringe can be introduced, until it comes to bear against a predetermined abutment means in a defined position. A connecting portion of an air pump can be operatively connected to the end portion of the syringe cylinder portion which is in opposite relationship to the injection needle thereof, for introducing compressed air into the ball through the injection syringe, when the piston thereof has been removed.

As will be seen in greater detail hereinafter with reference to a specific embodiment of the device according to the invention, the ball can be firmly held in the holding means which thus constitutes only a single housing-like structure for retaining the ball in position, and an injection syringe for example of present commercially available kind can be introduced through the handle portion of the device until the injection needle thereof has pierced the wall of the ball and extends into the interior of the ball. The syringe is positioned in such a way in that operation that the direction in which the needle penetrates into the ball is as far as possible radial, without having to carry or allow for additional guide forces. Thus, both when the needle is introduced into the ball of the ball and in the operation of injecting a sealing agent which can possibly be carried out by means of the syringe and in addition in the operation of pumping up the ball, which is effected through the body portion of the syringe and through the injection needle thereof, the needle is not subjected to any transverse forces which could tend to bend or even break off the needle. That means that is is possible to use extremely thin injection needles which produce such a small perforation in the wall of the ball that very small amounts of sealing agent are sufficient to reliably and permanently close off the perforation after the injection needle has been withdrawn, so that for example a tennis ball when treated in that way can be used again for tournament and match play over a prolonged period of time.

In addition, a hand device in accordance with the present invention is of only low weight while the handle portion thereof which only axially accommodates the injection syringe may easily be of such dimensions that the hand of the person operating the device can conveniently and comfortably grip the handle portion while the other hand of the operator is used to introduce the injection syringe through the longitudinal bore in the handle portion, possibly with sealing agent already drawn up into the injection syringe. Likewise, the operator can then use his or her other hand when necessary for urging the piston of the injection syringe into the syringe body portion for injecting the sealant into the ball, and then withdrawing the piston again.

It is likewise an easy operation then to introduce the air pump with the connecting portion connected thereto into the mouthpiece of the syringe cylinder, which projects out of the handle portion, with the handle portion and the end of the pump being held by the same hand so that the other hand is used to actuate the air pump. For that purpose it is possible to use an air pump which corresponds in design to air pumps as are commercially available for example for pumping up valve-bearing balls although the cylinder thereof is to be reduced in length relative to such pumps for example preferably to a length of around 14 centimetres, in order to make the arrangement easier to handle.

That therefore constitutes a small, light and easily handleable device which can be operated in a simple fashion and in which only a very small amount of sealing agent is likely to be consumed when pumping up a ball. As the increased pressure required to raise the internal pressure in the ball is produced by means of an air pump, it involves practically no operating costs.

Further objects, features and advantages of the present invention will be apparent from the following description of preferred embodiments thereof.

BRIEF DESCRIPTION OF THE DRAWINGS

FIG. 2 is a plan view of the device shown in FIG. 1 with the cover portion thereof having been removed, FIGS. 3 and 4 are respectively a partly sectional side view and a plan view of a pressure measuring arrangement of the hand device.

DESCRIPTION OF THE PREFERRED EMBODIMENTS

Figure 1:
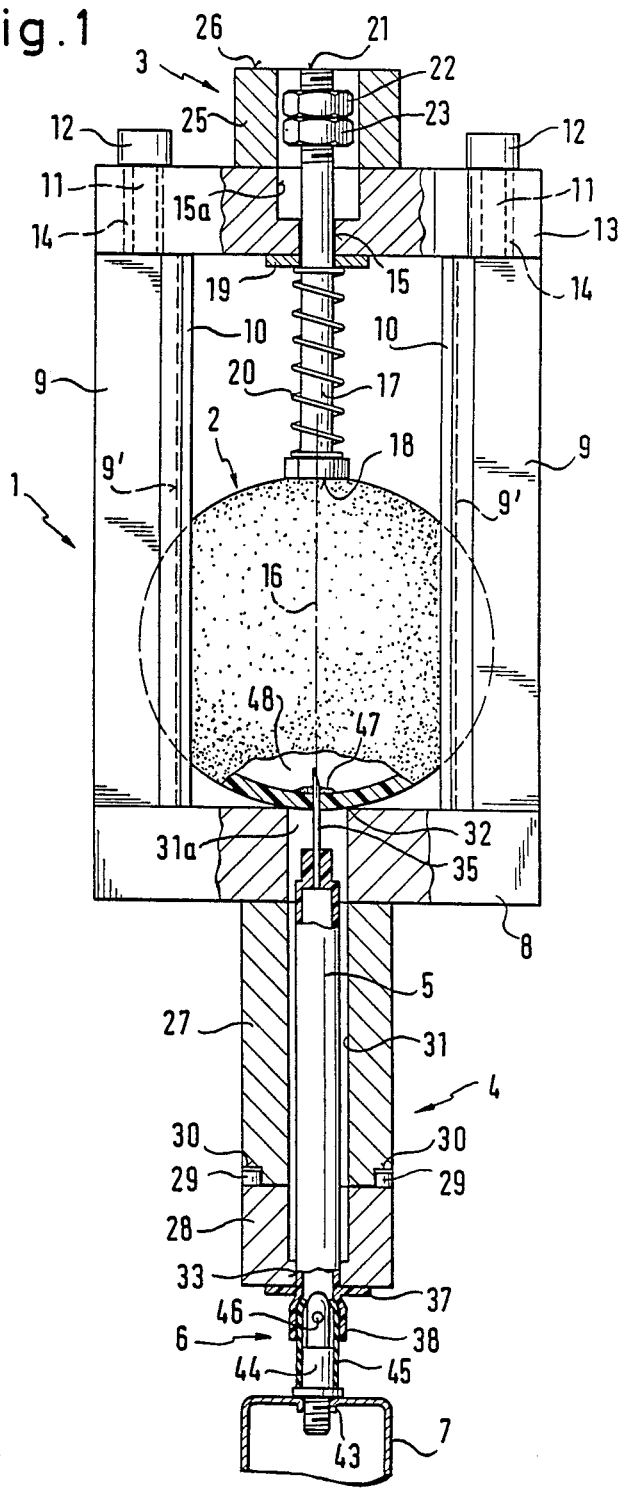
FIG. 1 is a side view of a first embodiment of a hand device according to the invention, with an inflated ball in position therein.

Referring firstly to FIGS. 1 through 6 the hand device illustrated therein for varying the gas pressure in a valve-less ball substantially comprises a holding means 1 for holding a ball 2 which for example has an excessively low internal pressure and which in the view shown in FIG. 1 has just reached the desired full internal pressure again after a pumping-up operation, a pressure measuring arrangement 3 for indicating the internal pressure in the ball, a handle 4 which is connected to the holding means 1, an injection syringe 5 which can be introduced into the handle 4 in the longitudinal direction thereof and whose piston is removed in FIG. 1, and an air pump 7 which can be connected to the free end of the injection syringe 5 by way of a connecting portion 6.

The holding means 1 for holding the ball 2 comprises a generally square or rectangular base plate as indicated at 8 and four columns or posts 9 which are arranged in mutually parallel relationship and which extend perpendicularly to the plane of the base plate 8. Each of the posts 9 is rigidly connected to the base plate 8 at a respective one of the corners thereof. The posts 9 which are square in cross-section and between which the ball 2 can be introduced until it comes to bear against the base plate 8, each form with their side edge which is directed radially inwardly relative to the ball 2 a guide edge 9' which however does not bear directly against the ball in the illustrated embodiment. On the contrary, extending along each guide edge 9' is a releasably mounted angle portion 10 which is of such a wall thickness that the ball 2 is held non-rotatably on the base plate 8 between the edges of the angle portions 10. That affords the option of also using the holding means 1 for balls which are somewhat larger than the illustrated ball 2, in which case the angle portions 10 are omitted. If still smaller balls than the illustrated ball 2 are to be accommodated in the holding means 1, then the illustrated angle portions 10 may be replaced by other angle portions which are of greater wall thickness; the relationship between the posts 9 and the angle portions 10 can be clearly seen also from FIG. 2.

At its end remote from the base plate 8, each of the posts 9 has a holding pin portion 11 with a head 12 which is enlarged to a larger diameter and by means of which a cover 13 of the holding means 1 can be releasably secured to the posts 9.

As shown in FIG. 4, the substantially square cover 13 is provided in the region of each of its corners with a respective guide slot 14 which extends inclinedly inwardly and which is of a slightly curved configuration. Each guide slot 14 is associated with and capable of co-operating with a respective one of the holding pins 11. Thus the pins 11 and the slots 14 together form a quick-release fastener for fixing the cover 13 to the posts 9, by means of a simple rotary movement. The cover 13 has a bore 15 which extends therethrough and whose axis, in the assembled condition of the holding means 1, coincides with the longitudinal axis of the holding means 1, as indicated at 16, which passes through the centre of the ball 2 and the centre of the base plate 8. Guided in the bore 15 in the cover 13, as can be clearly seen from FIG. 3, is a guide pin 17 which at its end towards the ball (see FIG. 1) has a head of enlarged diameter. The contact surface 18 of the enlarged head, which faces downwardly in FIG. 1, serves to bear against the ball 2. Carried on the sensor pin 17 are a coil spring 20 and a perforated disc or plate 19 which bears against the underside of the cover 13. The length of those components is such that when the cover 13 is fitted on to the posts 9, the contact surface 18 comes to bear against a ball 2 disposed in the holding means 1, and the compression spring 20 is compressed to a greater or lesser degree depending on the internal pressure in the respective ball 2. The end 21 of the pin 17 which is opposite to the contact surface 18 is pushed upwardly in FIG. 1 to a greater or lesser degree, through the bore 15 in the cover 13. The end 21 of the pin 17 thus forms a movable measuring mark, the position of which relative to a fixed measuring mark on the cover 13 represents a measurement in respect of the pressure obtaining in the ball 2.

So that the sensor pin 17 cannot drop out of the cover 13 when the cover 13 is removed, the pin 17 carries a nut 22 which is fixed by a lock nut 23, on a screwthreaded portion in the region of the free end 21 of the pin, disposed in a suitably enlarged portion 15a of the bore 15 in the cover 13. By varying the spacing of the nuts 22 and 23 from the head of the pin 17 which has the above-mentioned contact surface 18 and by using a suitable coil spring 20, it is possible to calibrate the pressure measuring arrangement of the device or set it to different ball diameters, if for example the upper nut 22 performs the function of the end 21 of the sensor pin 17. Fixed on the outward side of the cover 13, that is to say on the top side thereof as shown in FIGS. 1 and 3, is a gripping portion 25 having a bore which extends the bore 15 and is disposed in coaxial relationship therewith. The bore in the handle portion 25, as shown in FIG. 4, may be in the form of a recess 24 which is open radially at one side so that the movement of the free end 21 of the pin 17 can be better observed. In the embodiment shown in FIG. 1, the length of the pin 17 is so adapted to the axial length of the handle portion 25 and the spring characteristic of the coil spring 20 that the end 21 of the pin is just aligned with the outward end face of the handle portion 25 when the ball 2 is at the desired internal pressure. Accordingly the outer face 26 of the handle portion 25 forms the above-mentioned stationary measuring mark.

Fixed to the base plate 8 at the side thereof which is opposite to the posts 9 is the elongate handle 4 so positioned that its longitudinal axis coincides with the longitudinal axis 16 of the holding means 1. The handle 4 substantially comprises a handle portion 27 of square cross-section, which is fixed with its one end directly to the base plate 8, and a holding portion 28 which is releasably secured to the other end of the handle portion 27, for holding the injeciton syringe 5. The holding portion 28 is of the same cross-sectional dimensions as the handle portion 27 and has two axially projecting, mutually diametrally oppositely disposed guide pins or projections 29 which can be introduced into two recesses 30 in the handle portion 27 in such a way that in the assembled condition the outside edges of the handle portion 27 and the holding portion 28 are aligned with each other.

It will further be seen from FIG. 1 that the entire handle 4, that is to say both the handle portion 27 and the holding portion 28, have extending therethrough a longitudinal bore 31 which is coaxial with respect to the longitudinal axis 16. The longitudinal bore 31 is extended by a bore 31a which passes through the base plate 8 and which terminates with a sharp circular edge 32 in the surface of the base plate 8 which is towards the ball 2. A ball 2 which is accommodated in the holding means 1 is urged by the force of the coil spring 20 against the base plate 8 and thus also against the edge 32, and that, in conjunction with the edges of the angle portions 10 which bear against the ball, provides that the ball 2 is held in such a secure fashion that even during the pumping-up operation it is prevented from slipping or turning.

The inside diameter of the longitudinal bore 31 which serves to accommodate the injection syringe 5 is, with the exception of an end portion 33 in the holding portion 28, somewhat larger than the outside diameter of the cylinder body portion of the injection syringe. The inside diameter of the bore 31a which extends the longitudinal bore 31, in the base plate 8, is also somewhat larger than the outside diameter of the cylinder portion of the injection syringe. It is only the inside diameter of the end portion 33 of the longitudinal bore 31 that is substantially precisely matched to the outside diameter of the cylinder portion of the injection syringe so that the injection syringe, over the major part of the length thereof, has freedom to move radially, even if very slightly, thereby facilitating the operation of introducing the injection syringe 5 into the handle portion 27 and in particular ensuring that the injection needle 35 is not guided in too rigid a fashion. That means that there is no danger that the injection needle 35 may be bent or broken off when the injection syringe 5 is introduced into the longitudinal bore. That effect is further promoted by the feature that a part of the injection needle 35 remains outside the ball. The cylinder of the injection syringe 5 is a precise fit in the portion 33 of the bore in the holding portion 28 and remains connected thereto both upon insertion of the injection syringe 5 into the handle 27 and also upon the withdrawal thereof.

Figure 5:
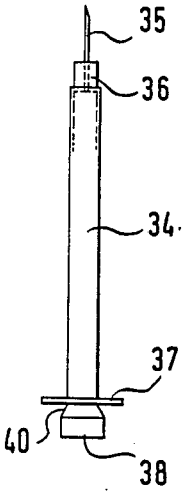
FIGS. 5 and 6 are respectively a side view of an injection syringe which can be introduced into the holding means of the hand device (without piston), and the piston belonging thereto.
Figure 6:
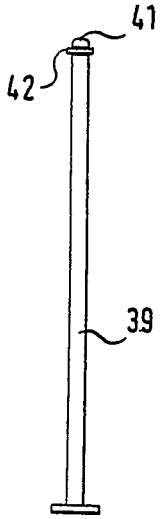

Referring now to FIGS. 5 and 6, the injection syringe 5 which may be formed for example by a conventional insulin syringe comprises a syringe cylinder portion 34, with the thin injection needle 35 being fitted by means of a needle holder 36 into the one end of the cylinder portion 34. At its other end the cylinder portion 34 has a radially outwardly projecting collar 37 and adjoining same an end portion 38 whose inside diameter is somewhat larger than the inside diameter of the remainder of the syringe cylinder portion, reference numeral 40 denoting an inclined transitional portion therebetween. That enlargement in the diameter of the cylinder portion 34 serves for more easily introducing the piston 39 of the syringe, which is shown in FIG. 6. At its front plunger portion 41 which is integrally connected to the remainder of the piston 39, the piston 39 is provided with a sealing ring 42 which is carried in an annular groove (not shown). In the inserted condition, the piston 39 which is introduced into the cylinder portion 34 almost completely fills the cylinder portion 34, as far as the needle holder 36.

It will further be seen from FIG. 1 that the ball 2 is pumped up by using an air pump 7 whose axially disposed outlet opening is in the form of a screwthreaded bore indicated at 43. Screwed into the screwthreaded bore 43 is a non-return valve 44 which may be formed for example by a type of valve which is conventionally used on bicycles. Pushed on to the freely projecting portion of the valve 44 is a tube portion 45 which, together with the valve 44, forms the connecting portion 6 of the air pump 7. The inside diameter thereof is so adapted to the outside diameter of the valve that it is held thereon by friction. The outside diameter of the tube portion 45 is so adapted to the inside diameter of the end portion 38 of the syringe cylinder portion 34 that it can be readily pushed into that end portion 38 and a sufficiently air-tight connection is provided at the tapering transitional portion 40 which joins the end portion 38 of the cylinder portion 34 to the narrower part thereof.

Having thus described the general structure and layout of the hand device of this invention, use thereof will now be briefly described hereinafter.

For the purposes of adjusting the internal pressure in a ball, the holding means 1 is held by one hand of the operator at the handle portion 27, with the cover 13 and the holding portion 28 initially being removed. The operator uses his or her second hand to introduce the ball 2 into position between the posts 9 and to push it down until it reaches the base plate 8 whereupon the cover 13 is fitted into position and locked to the posts 9 by means of the holding pins 11. With the device in that condition, the sensing pin 17 bears with its surface 18 against the outside surface of the ball 2, on the side thereof which is in opposite relationship to the base plate 8. It is urged against the outside surface of the ball 2 by the coil spring 20 which is under a certain amount of prestressing.

Thereupon the injection syringe 5 which is introduced into the holding portion 28 is filled with for example about 0.05 ml of a sealing agent by dipping the injection needle 35 into a suitable storage container and withdrawing the piston 39 into the body portion of the syringe. The sealing agent preferably comprises for example a mixture of cleaning spirit and a conventional rubber solution. The ratio of those two components is such that the resulting viscosity of the mixture permits the sealing agent to be readily injected into the ball through the respective injection needle 35 used. The holding portion 28 is then fitted to the handle portion 27, with the guide projections 29 engaging into the recesses 30, and then the injection syringe 5 is introduced into the handle portion 27 until the injection needle 35 penetrates the wall of the ball 2 and extends into the interior thereof as indicated at 48. In the final position of the injection needle 35, a small part thereof extends into the interior 48 of the ball.

Thereupon the sealing agent is injected into the interior 48 of the ball be depressing the piston 39 into the cylinder portion 34 of the syringe. The holding means 1 is held in such a way that the longitudinal axis 16 thereof is disposed substantially vertically and the ball 2 is positioned above the injection syringe 5. As a result of that positioning, in the fashion shown in FIG. 1, the injected sealing agent accumulates in the lower region of the interior 48 of the ball and thus forms a small pool 47 around the part of the injection needle 35 which projects into the ball. The piston 39 is then withdrawn downwardly from the cylinder portion 35 of the syringe, without changing the position of the holding means 1. Any sealing agent which has remained in the injection needle 35 is sucked back into the cylinder portion 34 of the syringe, by the withdrawal movement of the piston 39. By again pressing in the piston 35, that residual agent is removed with the plunger portion 41.

Next, the air pump 7 is brought up to the cylinder portion 34 of the syringe from below and the valve 44 with the tube portion 45 surrounding same is introduced into the end portion of the cylinder portion 34 of the syringe. The only short length of the projecting valve 44 means that the operator's hand which grasps the handle 4 of the device can now at the same time also grasp the downwardly adjacent end of the air pump 7 and hold the two components jointly so that the air pump 7 can be actuated with the other hand and thus air can be injected into the interior 48 of the ball through the valve 44, the cylinder portion 34 and the injection nozzle 35 until the desired pressure in the ball 2 is reached. That can be seen by virtue of the upper end 21 of the pin 17 being aligned with the outer surface 26 of the gripping portion 25.

Thereupon the air pump 7, the holding portion 28 and the injection syringe 5 are jointly pulled off downwardly and disconnected from the remainder of the holding means 1. When that is done, the sealing agent flows from the pool 47 into the perforation in the wall of the ball from which the injection needle 35 has now been withdrawn, and is pressed into the perforation by virtue of the pressure obtaining in the interior 48 of the ball and thus sealingly closes off the perforation so that no noticeable drop in pressure occurs in the ball by virtue of the injection needle 35 being withdrawn therefrom.

Then, after removal of the cover 13 from the posts 9, the ball can be removed from the holding means 1, the air pump 7 can be disconnected from the cylinder portion 34 of the syringe and the hand device can be prepared in the above-indicated fashion for changing the pressure in another ball, as desired. If, in such an operation of pumping up a ball, the pressure in the ball should somewhat exceed the desired pressure, which is indicated by the upper end 21 of the pin 17 projecting beyond the outer end face 26 of the gripping portion 25, then it is only necessary to withdraw the air pump 7 somewhat from the end portion 38 of the cylinder portion 34 of the syringe so that air can escape from the ball to the atmosphere by way of the injection needle 35 and the cylinder portion 34 of the syringe.

Figure 7:
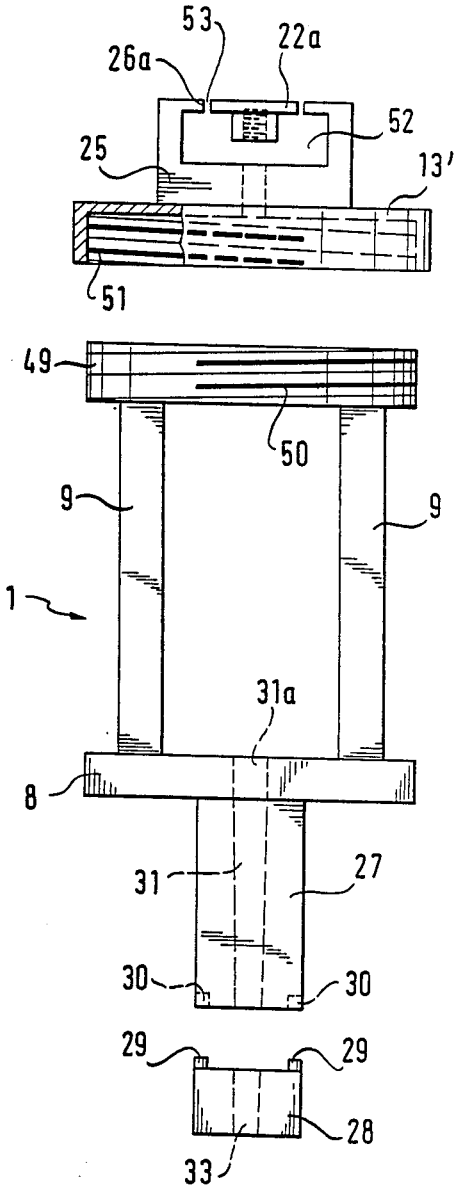
FIG. 7 is a simplified side view of a second embodiment of the hand device according to the invention, parts thereof which are modified in comparison with the first embodiment being shown in an exploded condition.

Reference will now be made to FIG. 7 showing a further embodiment of the hand device in which parts corresponding to the embodiment described above are denoted by the same reference numerals. In the device shown in FIG. 7, secured to the ends of the posts 9 which are in opposite relationship to the base plate 8 is an annular plate 49 having an outside screwthread as indicated at 50 on to which an also circular cover 13' can be screwed in the manner of a cap nut, for which purpose the cover 13' has an internal screwthread 51. In this embodiment a transverse groove 52 passes through the gripping portion 25 which at its top has an opening 53 which is narrower than the width of the transverse groove 52, thereby providing an inwardly projecting edge portion which can serve as a stationary measuring marker as indicated at 26*a*. The movable measuring mark is formed in this embodiment by a cap nut 22*a* which is screwed on to the upper end of the sensing pin which was indicated at reference 17 in for example FIG. 1 but which is not shown in FIG. 7; in the same manner as the nut 22 in the embodiment shown for example in FIG. 1, the cap nut 22*a* is locked in position by a lock nut which is also not shown in FIG. 7. In that situation the cap nut 22*a* and the lock nut do not have to be in contact directly with each other. On the contrary, the force may be transmitted from one of those two nuts to the other by a compression spring which is arranged between the two nuts and which is disposed concentrically around the sensor pin. The fact that the upper nut is in the form of the cap nut 22*a* gives the advantage that that nut which thus serves at the same time as the movable measuring mark can be longitudinally displaceable over a certain range on the sensing pin and can be fixed thereon. The transverse groove 52 which is open towards both sides performs the function of the opening 24 which was open at one side in the embodiment described above with reference to FIGS. 1 through 6, and permits improved viewing of the movement of the cap nut 22*a* while it is still below the fixed measuring mark 26*a*.

As FIG. 7 also shows, the longitudinal bore 31 which extends through the handle 4 is in this embodiment of a slightly tapering configuration throughout. It tapers inwardly towards the free end of the handle 4 to such a degree that the injection syringe which is not shown in FIG. 7 is held in the same manner in the lower holding portion 28 of the handle 4, as in the holding portion 28 shown for example in FIG. 1. The bore 31*a* which extends the longitudinal bore 31 in the base plate 8 is also in this embodiment of an inside diameter which is greater than the outside diameter of the cylinder portion 34 of the syringe and is preferably equal to the largest inside diameter of the longitudinal bore 31 so that there is also a stepless smooth transition from one bore into the other.

So that the cap nut 22*a* which is disposed between or within the fixed measuring marks 26*a* can be easily rotated relative to the sensing pin 17, a transverse groove which is not shown in FIG. 7 may be provided on the top side of the cap nut 22*a*, for accommodating a screw driver.

It has been found that the above-described constructions of the holding means 1 provide that it is possible to use injection syringes with particularly thin injection needles. When dealing with certain balls, that means that it is possible to ensure that the perforation formed by the injection needle can be closed off in an adequately air-tight and long-lasting fashion after the injection needle has been removed from the ball, even without involving the injection of a sealing agent into the ball.

It will be appreciated that the above-described constructions have been set forth solely by way of example and illustration of the present invention and that various modifications and alterations may be made therein without thereby departing from the scope of the invention.

What is claimed is:

1. A hand device for varying the gas pressure in a valve-less ball comprising an elongate holding means for non-rotatably accomodating a said ball including:

a base plate extending transversely with respect to the longitudinal direction of the holding means of supporting the ball, the base plate having a substantially central opening therethrough, a cover means disposed at a spacing from the base plate in the longitudinal direction of the holding means, for accomodating the ball between the base plate and the cover means, a handle portion connected to the base plate on the side thereof in opposite relationship to the cover means and having a conduit therethrough for a flow of compressed air in relation to the ball, an injection syringe having a hollow injection needle and a syringe cylinder adapted to be inserted into said conduit in said handle portion until said syringe cylinder is in a predetermined abutment position in said conduit, in which said hollow needle projects through said opening in said base plate and is thereby operable to pierce the ball supported by the base plate, to extend into the interior of the ball, said conduit in said handle portion having a reduced end portion whose inside diameter is adapted to the outside diameter of the syringe cylinder in such a way that the injection syringe is held without play in said conduit end portion, the conduit increasing in width from the reduced end portion towards the base plate, and said opening in said base plate being a bore which extends said conduit and whose smallest inside diameter is larger than the outside diameter of the syringe cylinder, and the abutment position of said injection syringe in said handle portion being so selected that in operation the injection needle remains with a part of its length outside the ball, a ball pressure measuring means comprising a measuring member which is movable in the axial direction of the holding means and which in the operative position of the device is capable of bearing against the ball on the side thereof which is in opposite relationship to the base plate, the measuring member having a first measuring marking means thereon, a spring means operable to urge the measuring member towards said ball, and a stationary measuring marking means on the holding means, alignment of the first and second measuring marking means indicating the attainment of a desired gas pressure in the ball, and means operatively associated with said syringe cylinder for sealingly connecting said syringe cylinder to an air pump for introducing compressed air through the injection syringe, with the piston thereof removed therefrom, and by way of the injection needle into the interior of the ball.

2. A device as set forth in claim 1 wherein said spring bears against said cover means.

3. A device as set forth in claim 1 wherein the injection syringe is a disposable syringe whose injection needle is non-releasably connected to the syringe cylinder and directly adjoins same and having an actuating pressing plunger fixedly connected to the piston of the syringe.

4. A device as set forth in claim 1 wherein said movable measuring member is a sensor pin passing outwardly through the cover means and having an outer end portion providing the first measuring marking means, wherein said spring means is a compression spring disposed around said sensor pin, and wherein the stationary measuring marking means is disposed on the cover means.

5. A device as set forth in claim 4 wherein the movable measuring marking means is a cap nut screwed adjustably on the outer end portion of the sensor pin.

6. A device as set forth in claim 1 wherein the handle portion at its end remote from the base plate has a holding portion which can be pulled off in the axial direction thereof and which has a bore extending therethrough in the axial direction, said bore in the holding portion forming in the operative position a part of said conduit and embracing the reduced end portion thereof.

7. A device as set forth in claim 1 wherein said connecting means is a connecting portion having a non-return valve operable to open towards the injection syringe.

8. A device as set forth in claim 7 wherein the non-return valve is a bicycle valve capable of being screwed into an axial screwthreaded discharge bore of the air pump and the connecting portion also comprises an elastic tube portion which sealingly embraces the connecting region of the valve and which is adapted at its free end to the inside diameter of the adjacent end portion of the syringe cylinder.

9. A device as set forth in claim 1 wherein between the base plate and the cover means the holding means has posts for enclosing the ball between them.

10. A device as set forth in claim 9 wherein each said post has a respective radially inwardly directed edge against which the ball bears.

11. A device as set forth in claim 10 wherein each radially inwardly directed edge is a component of a respective angle portion mounted to the post in question.

12. A device as set forth in claim 11 wherein a plurality of angle portions of different gauges are provided for each of the posts, thereby to compensate for different ball diameters.

13. A device as set forth in claim 9 wherein the posts are rigidly connected to the base plate and the cover means is connectible to the posts by quick-release fastening means.

14. A device as set forth in claim 1 wherein the opening in the base plate is provided with a sharp edge on the side which is towards the cover means.

15. A hand device for varying the gas pressure in a valve-less ball comprising an elonage holding means for non-rotatably accommodating a said ball including: a base plate extending transversely with respect to the longitudinal direction of the holding means, for supporting the ball, the base plate having a substantially central opening therethrough; a cover means disposed at a spacing from the base plate in the longitudinal direction of the holding means, for accommodating the ball between the base plate and the cover means; a handle portion connected to the base plate on the side thereof in opposite relationship to the cover means and having a conduit therethrough for a flow of compressed air in relation to the ball; an injection syringe having a hollow injection needle and a syringe cylinder adapted to be inserted into said conduit in said handle portion until said syringe cylinder is in a predetermined abutment position in said conduit, in which said hollow needle projects through said opening in said base plate and is thereby operable to pierce the ball supported by the base plate, to extend into the interior of the ball; a ball pressure measuring means comprising a measuring member which is movable in the axial direction of the holding means and which in the operative position of the device is capable of bearing against the ball on the side thereof which is in opposite relationship to the base plate, the measuring member having a first measuring marking means thereon, a spring means operable to urge the measuring member towards said ball, and a stationary measuring marking means on the holding means, alignment of the first and second measuring marking means indicating the attainment of a desired gas pressure in the ball; and means operatively associated with said syringe cylinder for sealingly connecting said syringe cylinder to an air pump for introducing compressed air through the injection syringe, with the piston thereof removed therefrom, and by way of the injection needle into the interior of the ball; wherein said movable measuring member is a sensor pin passing outwardly through the cover means and having an outer end portion providing the first measuring marking means, wherein said spring means is a compression spring disposed around said sensor pin, and wherein the stationary measuring marking means is disposed on the cover means.

16. A device as set forth in claim 14, wherein the movable measuring measuring marking means is a cap nut screwed adjustably on to the outer end portion of the sensor pin.

17. A hand device for varying the gas pressure in a valve-less ball comprising an elonage holding means for non-rotatably accommodating a said ball including: a base plate extending transversely with respect to the longitudinal direction of the holding means, for supporting the ball, the base plate having a substantially central opening therethrough; a cover means disposed at a spacing from the base plate in the longitudinal direction of the holding means, for accommodating the ball between the base plate and the cover means; a handle portion connected to the base plate on the side thereof in opposite relationship to the cover means and having a conduit therethrough for a flow of compressed air in relation to the ball; an injection syringe having a hollow injection needle and a syringe cylinder adapted to be inserted into said conduit in said handle portion until said said syringe cylinder is in a predetermined abutment position in said conduit, in which said hollow needle projects through said opening in said base plate and is thereby operable to pierce the ball supported by the base plate, to extend into the interior of the ball; a ball pressure measuring means comprising a measuring member which is movable in the axial direction of the holding means and which in the operative position of the device is capable of bearing against the ball on the side thereof which is in opposite relationship to the base plate, the measuring member having a first measuring marking means thereon, a spring means operable to urge the measuring member towards said ball, and a stationary measuring marking means on the holding means, alignment of the first and second measuring marking means indicating the attainment of a desired gas pressure in the ball; and means operatively associated with said syringe cylinder for sealingly connecting said syringe cylinder to an air pump for introducing compressed air through the injection syringe, with the piston thereof removed therefrom, and by way of the injection needle into the interior of the ball; wherein the conduit in the handle portion has a reduced end portion whose inside diameter is adapted to the outside diameter of the syringe cylinder in such a way that the injection syringe is held without play in said conduit end portion, the conduit increases in width from the reduced end portion towards the base plate, and the opening in the base plate is a bore which extends said conduit and whose smallest inside diameter is larger than the outside diameter of the syringe cylinder.

18. A device as set forth in claim 17 wherein the handle portion at its end remote from the base plate has a holding portion which can be pulled off in the axial direction thereof and which has a bore extending therethrough in the axial direction, said bore in the holding portion forming in the operative position a part of said conduit and embracing the reduced end portion thereof.

* * * * *